US005183509A

United States Patent [19]

Brown et al.

[11] Patent Number: 5,183,509

[45] Date of Patent: Feb. 2, 1993

[54] APPARATUS FOR APPLICATION OF A MATERIAL TO AN INTERNAL SURFACE OF ITEMS OF MANUFACTURE

[75] Inventors: Robert L. Brown, Hartville; David E. Baxter, Ravenna; Todd A. England, North Canton, all of Ohio

[73] Assignee: GenCorp Inc., Fairlawn, Ohio

[21] Appl. No.: 692,100

[22] Filed: Apr. 26, 1991

[51] Int. Cl.[5] ..... B05C 1/02; B05C 17/06

[52] U.S. Cl. ..... 118/696; 118/697; 118/620; 118/64; 118/66; 118/215; 118/220; 118/224; 118/233; 118/243; 118/254; 118/258; 118/263; 118/500; 118/DIG. 10

[58] Field of Search ..... 118/696, 697, 712, 620, 118/64, 66, 215, 220, 224, 232, 233, 243, 254, 258, 263, 500, DIG. 10

[56] References Cited

U.S. PATENT DOCUMENTS

| | | | |
|---|---|---|---|
| 1,676,815 | 7/1928 | Beatty | 118/DIG. 10 |
| 2,284,491 | 5/1942 | Mandell | 118/215 |
| 2,365,775 | 3/1944 | Punte . | |
| 2,868,162 | 1/1959 | Knain | 118/233 |
| 3,098,764 | 7/1963 | Kao et al. | 118/DIG. 10 |
| 3,117,026 | 1/1964 | Spier | 118/215 |
| 3,310,029 | 12/1962 | Ivanoff et al. . | |
| 3,766,851 | 10/1973 | Sirvet et al. . | |
| 3,902,453 | 9/1975 | Frische | 118/66 |
| 3,955,496 | 5/1976 | Urban . | |
| 4,056,185 | 11/1977 | Cartwright . | |
| 4,066,038 | 1/1978 | Shutie et al. . | |
| 4,115,172 | 9/1978 | Baboff et al. | 118/215 |
| 4,296,708 | 10/1981 | Robertson et al. . | |
| 4,433,776 | 2/1984 | Edwards, Jr. et al. . | |
| 4,453,626 | 6/1984 | Roberts et al. . | |
| 4,608,646 | 8/1986 | Goodrich et al. . | |
| 4,738,866 | 4/1988 | Conklin et al. | 118/712 |
| 4,753,336 | 6/1988 | Taylor et al. . | |
| 4,836,139 | 6/1989 | Davies | 118/696 |
| 4,886,157 | 12/1989 | Sunnen et al. . | |

FOREIGN PATENT DOCUMENTS

| | | | |
|---|---|---|---|
| 1359549 | 12/1987 | U.S.S.R. | 118/215 |

*Primary Examiner*—W. Gary Jones
*Assistant Examiner*—Todd J. Burns

[57] ABSTRACT

An apparatus for application of material to the internal surface of cylindrical items of manufacture. The apparatus includes a frame, a transport system having work stations supporting the items, an application system, and a curing system for curing the material applied to the cylindrical items. The application system includes a drive roll, movable into engagement with the item for rotating the item, a coating roll movable between a position engaging the internal surface of the item to apply the desired material, and a position engaged with a reservoir system having a rotating supply roll for supplying the coating roll with material.

6 Claims, 12 Drawing Sheets

| | | |
|---|---|---|
| 1A | 1B | 1C |

| 1A | 1B | 1C |
|---|---|---|

| 1A | 1B | 1C |
|---|---|---|

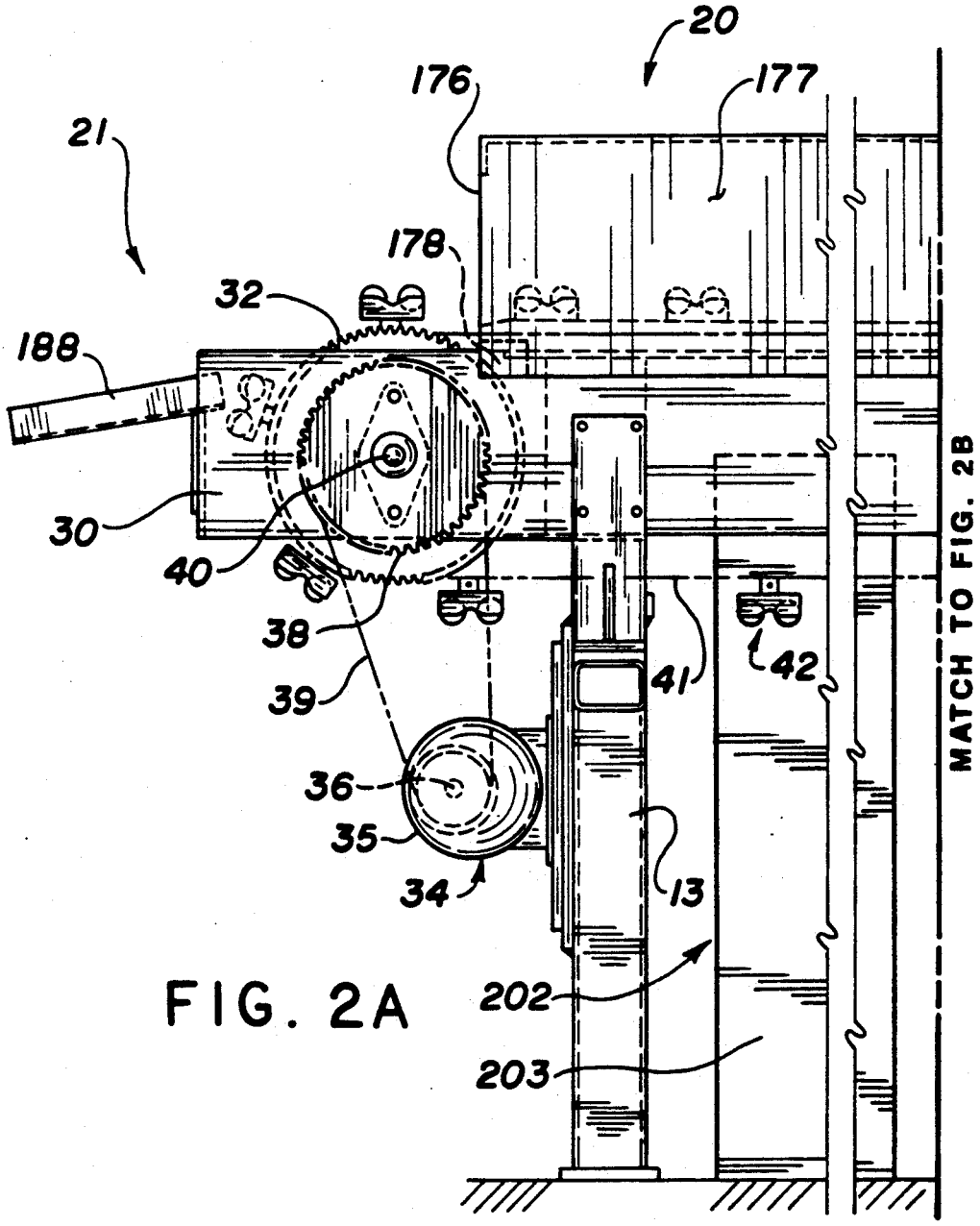
FIG. 2A
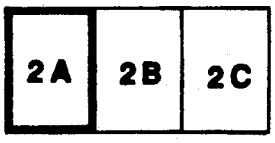

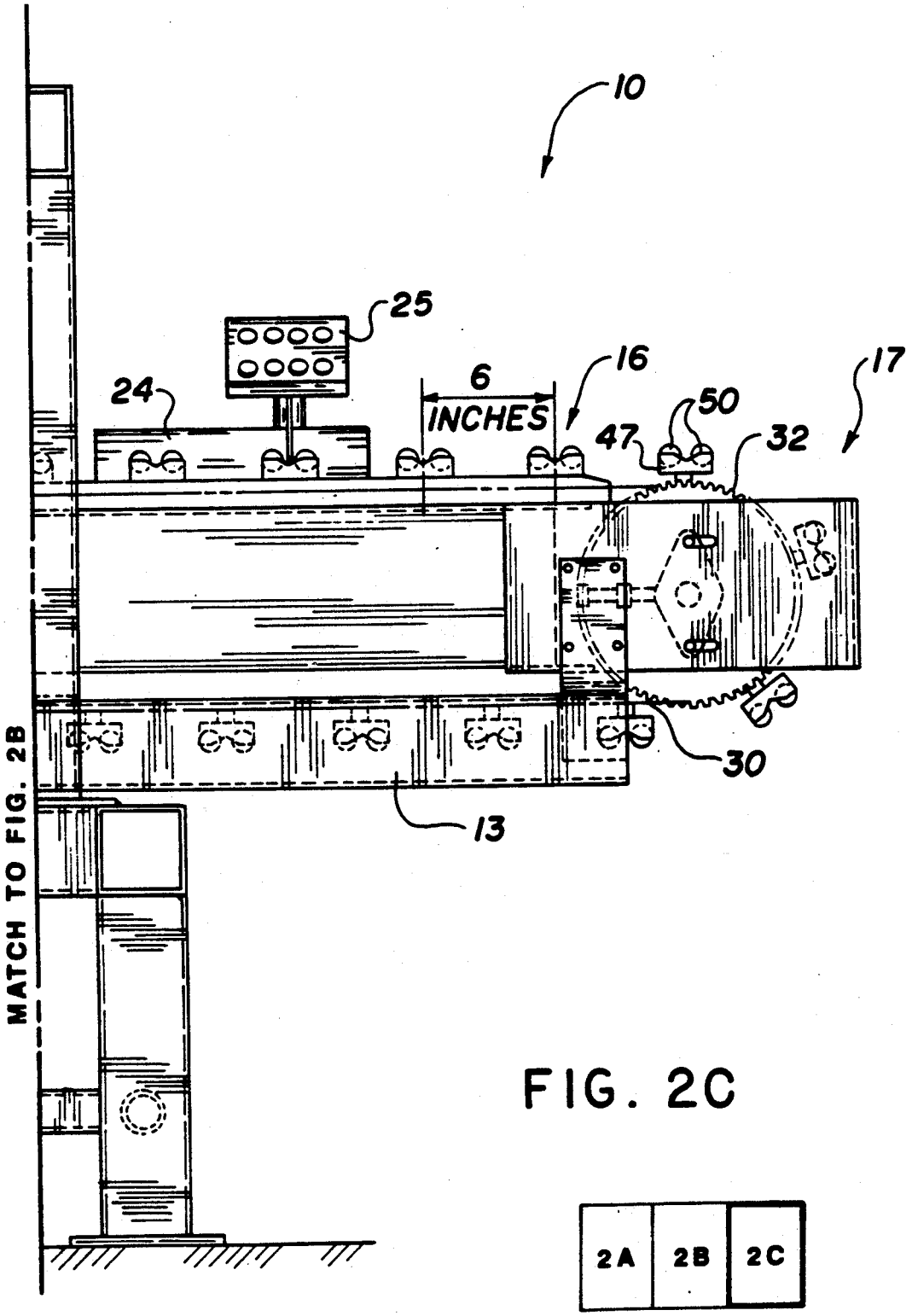
FIG. 2C
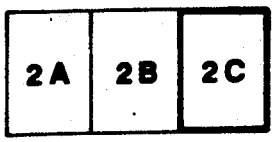

APPARATUS FOR APPLICATION OF A MATERIAL TO AN INTERNAL SURFACE OF ITEMS OF MANUFACTURE

TECHNICAL FIELD

The present invention relates to an apparatus for applying material, and more particularly to an apparatus for the application of a liquid material to the internal diameters of cylindrical items of manufacture.

BACKGROUND OF THE INVENTION

Devices for applying liquid materials to cylindrical items of manufacture are well known in the manufacturing industry. The internal diameters of cylindrical items are, for example, coated with paint or other material in the packaging industry, and with adhesive material in the automotive parts industry. One common method of applying adhesive material to parts manufactured for the automotive industry is spray coating.

One disadvantage of the spray coating process in connection with the application of adhesive is that it is quite inefficient. It is estimated that only 15%–20% of sprayed coating material adheres to the part surface being coated. Thus, as much as 80%–85% of the often expensive coating material being sprayed may be "lost".

An additional disadvantage, is that the adhesives typically used for automotive parts in spray processes are often volatile organic based materials. The atomization of such materials may result in vapors which should not be released directly into the environment. Thus, the "lost" material must be reclaimed. Reclamation of such material typically involves the use of a water retrieval system. Treatment of the waste water resulting from the operation of retrieval systems is also expensive.

Roll coating of both the internal and external diameters of cylindrical parts with adhesive material is provided, for example, in U.S. Pat. No. 2,365,775. In devices of this type, the cylindrical part is mounted on supporting rolls and engaged by a rotating drive roller. Such devices are not believed to enable the precise application of a desired specific coating thickness, and do not address the application of adhesive to the entire internal and external diameter surfaces.

SUMMARY OF THE INVENTION

The present invention provides a new and improved apparatus for application of a coating material to the internal diameters of cylindrical items of manufacture, respectively. The apparatus is preferably designed to apply material to an increased number of cylindrical items, and to apply the material in precise and desired amounts. The precision application of material provided by the present invention also increases the repeatability of material application to the internal diameter of the items.

An apparatus according to the present invention includes a frame supporting a transport system, an application system, a curing system for curing the material applied to the cylindrical items and a controller for automatically controlling position and movement of the cylindrical items through the apparatus at preprogrammed desired locations and specified speeds. The cylindrical items may be supplied to the transport system by a manual feed system whereby the items are provided to the transport system by an operator, or an automatic system, such as rotary or vibratory feeder systems. A take-away system for removing the completed items from the apparatus may also be used, and may be a gravity feed chute to a separate container, or a separate conveyor system for automatic removal of the items to their next and any final process station.

The application and curing systems are enclosed by clear walls and covers to enable viewing of the apparatus during its operation, while maintaining the safety of the operator against moving parts and fumes which may result from application of the material. To ensure that the operator or others cannot gain access to the apparatus during operation, a series of door interlock switches are preferably positioned such that opening of the covers to gain access to the apparatus ceases its operation.

The transport system for moving the cylindrical items is a continuous conveyor with multiple work stations supporting the items. The work stations include two support rolls rotatably mounted on a base member. A single drive mechanism operates the conveyor of the transport system and thus ensures synchronized movement of the cylindrical items within the apparatus.

After being loaded onto the transport system conveyor, the cylindrical items are moved in their respective work stations to the application system. Each application system includes two coating stations. Additionally, the application system includes a driving system, a coating roll system and a reservoir system. Each of the driving, coating roll and reservoir systems includes a drive mechanism. Additionally, each of the driving, coating roll and reservoir systems includes two horizontally and axially spaced rolls, one of each of which is located at each of the coating stations. In the driving system, each roll is movable into engagement with the external diameter of a cylindrical item to rotate the item in its work station as it is moved along the transport system. In the coating roll system, each roll engages the internal diameter of a cylindrical item as it is moved along the transport system. The coating rolls are moved between engagement with the reservoir system rolls and engagement with the internal surface of a cylindrical item. The driving and coating rolls are independently rotated via variable speed rotary drive gear motors mounted on the frame.

To coat the desired material on the internal surface of the item, the driving and coating rolls can be programmed to rotate in either direction, such that the cylindrical items may be rotated on their support rolls in the same direction as the coating rolls. Upon completion of the desired number of revolutions of the items, the driving and coating rolls are removed from engagement with the item The rolls of the reservoir system are supported within a reservoir tank containing the desired coating material. The contact between the rolls and reservoir tank during operation of the apparatus provides continuous agitation of the liquid material within the reservoir tank. The material reservoir tanks are readily removable to enable maintenance of the apparatus, or to change the liquid material in the reservoir tank. Use of the apparatus of the present invention reduces the percentage of material wasted during the application process to 15% or less.

Upon exiting the application system, the conveyor may move the cylindrical items into communication with a second application system, or with the curing system. Combinations of single or multiple application systems may be used, each of which is typically associated with a curing system before another single or multiple application system and associated curing system are provided.

The curing system includes either or both a heating oven and a drying chamber. A heating oven may be necessary to cure the material under increased temperatures, for example. Alternatively, a drying chamber may be necessary to air dry the material. The present invention includes a heating and drying chamber, which additionally includes a ventilation system for providing ambient air to the chamber, and an exhaust system which is used to discharge air and fumes from the chamber. The ventilation system directs heated drying air across the surfaces of the cylindrical items exiting the application system. The exhaust system also pulls the air through the chamber. The items are quickly dried by properly maintaining and controlling air temperature and flow over the cylindrical items and through the chamber. Additionally, necessary environmental requirements are also satisfied by controlling the air exiting the chamber using the exhaust system.

As the cylindrical items are cured within the curing system and approach the curing system exit, they are removed from their work stations on the transport system conveyor to a take-away system. From exiting the curing system, via the take-away system, the cylindrical items may be removed to a still further and any final processing station Other features and advantages of the present invention will become apparent from the following detailed description of the preferred embodiments made with references to the accompanying drawings, which form a part of the specification.

BRIEF DESCRIPTION OF THE DRAWINGS

FIGS. 2A, 2B and 2C are schematic partial front views of a second embodiment of the apparatus of the present invention;

DETAILED DESCRIPTION OF THE PREFERRED EMBODIMENTS

Figure 1A:
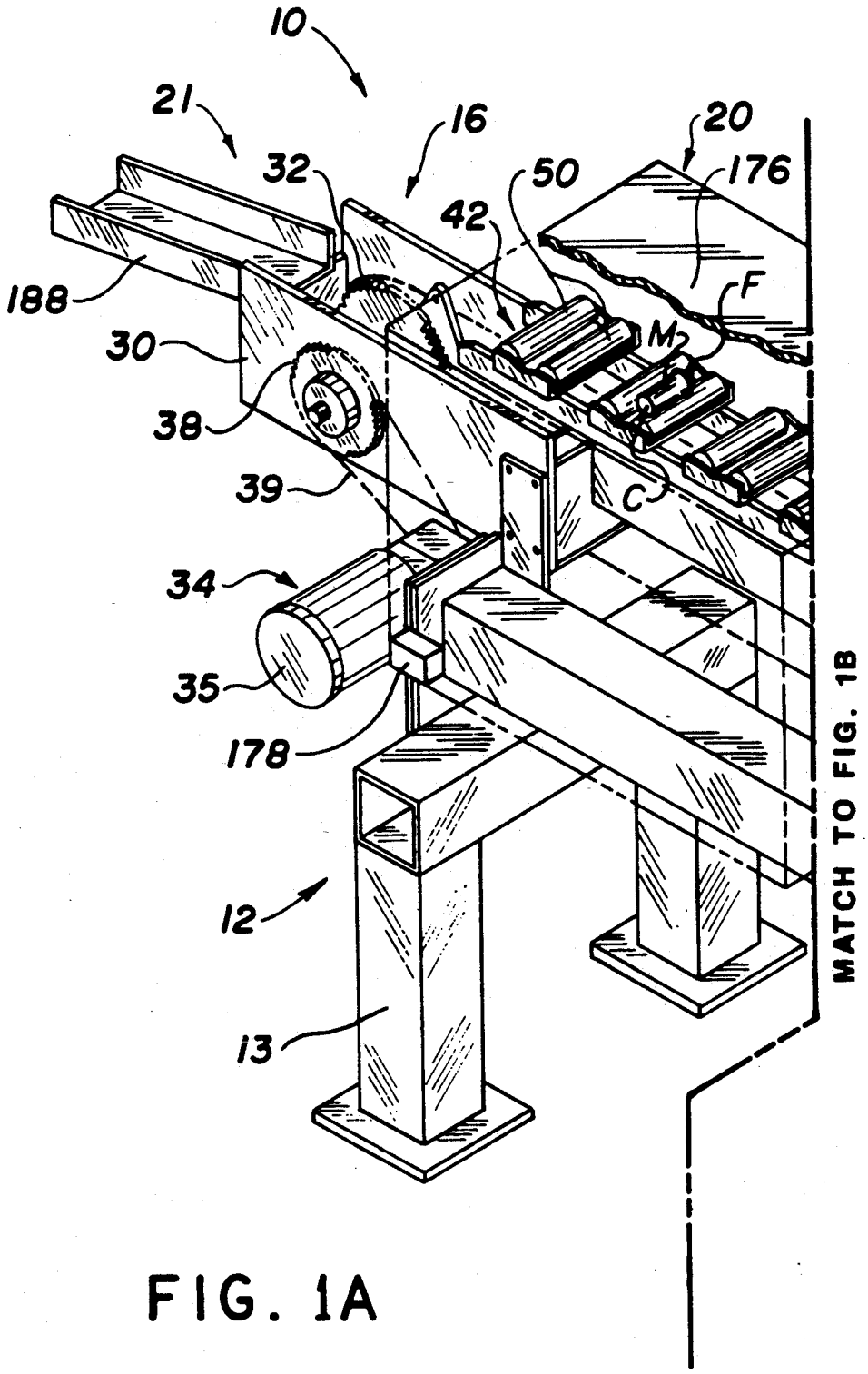
FIGS. 1A, 1B, and 1C illustrate schematic partial perspective views of an apparatus for applying material to the internal diameters of cylindrical items in accordance with the present invention.
Figure 1B:
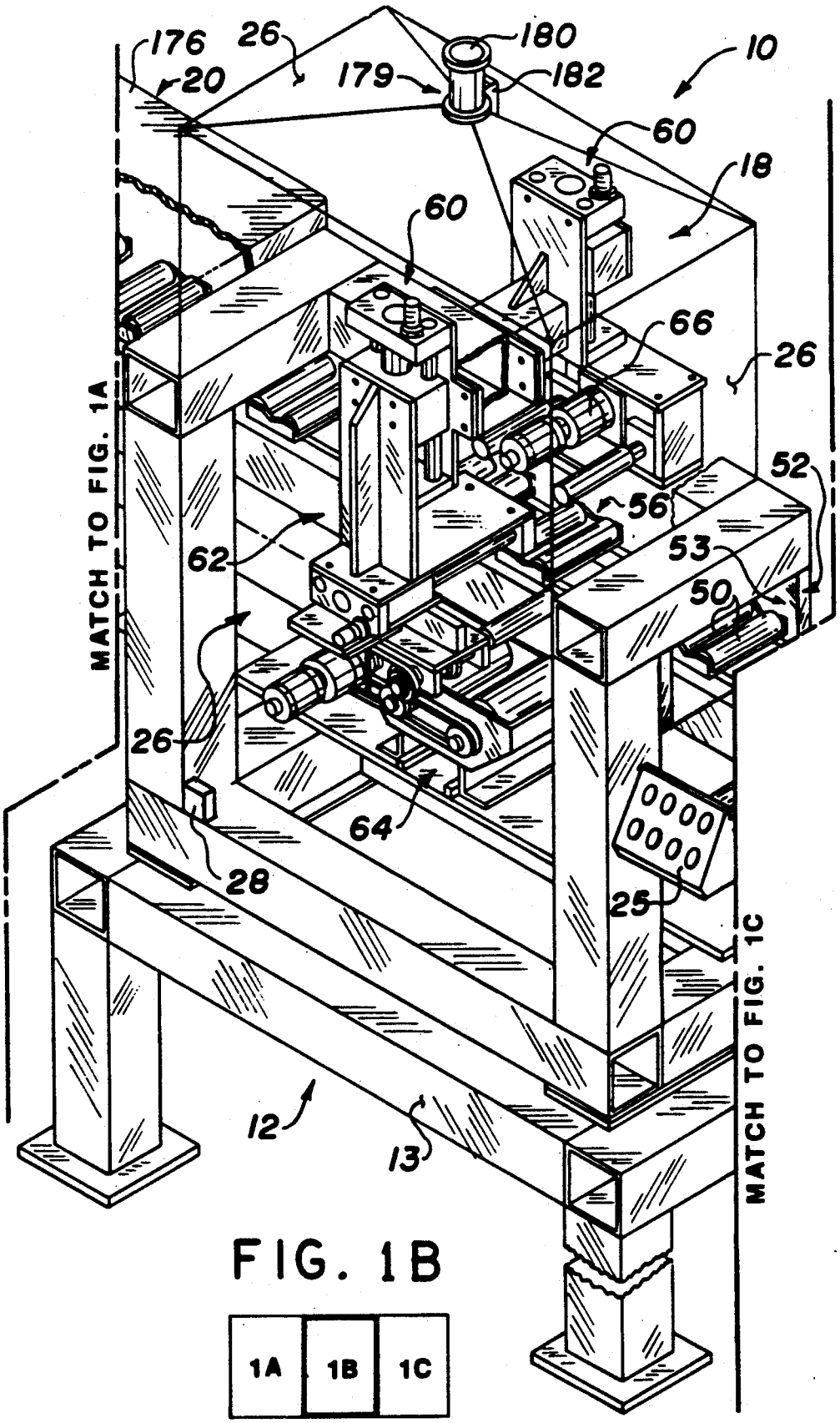
Figure 1C:
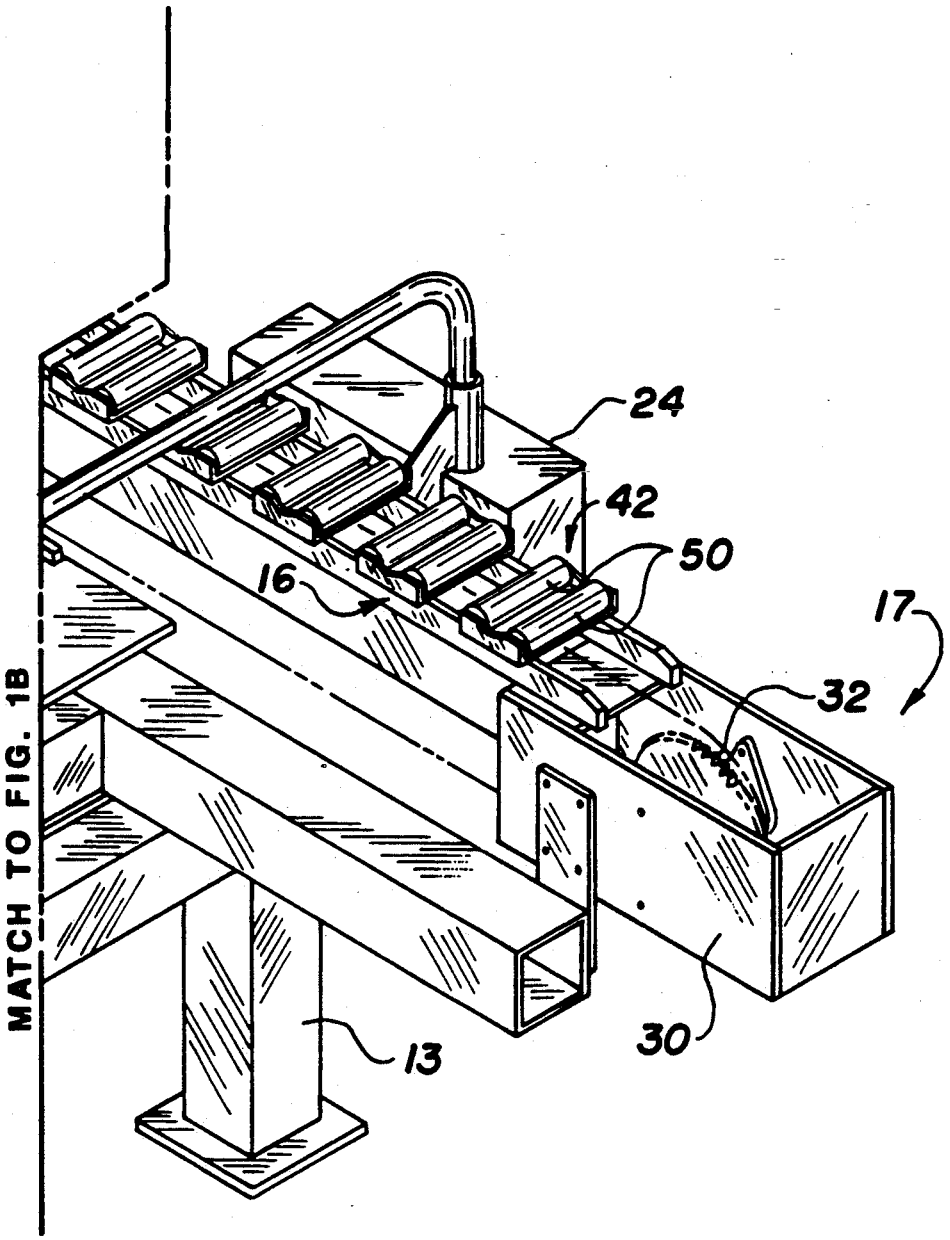

FIGS. 1A, 1B and 1C illustrate an apparatus for applying material M to the internal diameters of straight cylindrical items C or items having a flanged end F. The apparatus, generally referred to at reference numeral 10, includes a frame 12 supporting a transport system 16. Also provided are an application system 18, a curing system 20 for curing the material M applied to the cylindrical items C, and a controller 24 for controlling position and movement of the cylindrical items C through the apparatus 10 at desired locations and specified speeds which are determined experimentally and preprogrammed into the controller. The frame 12 comprises metal support members 13 for supporting and defining the transport, application and curing systems, 16, 18, 20, respectively.

Figure 2B:
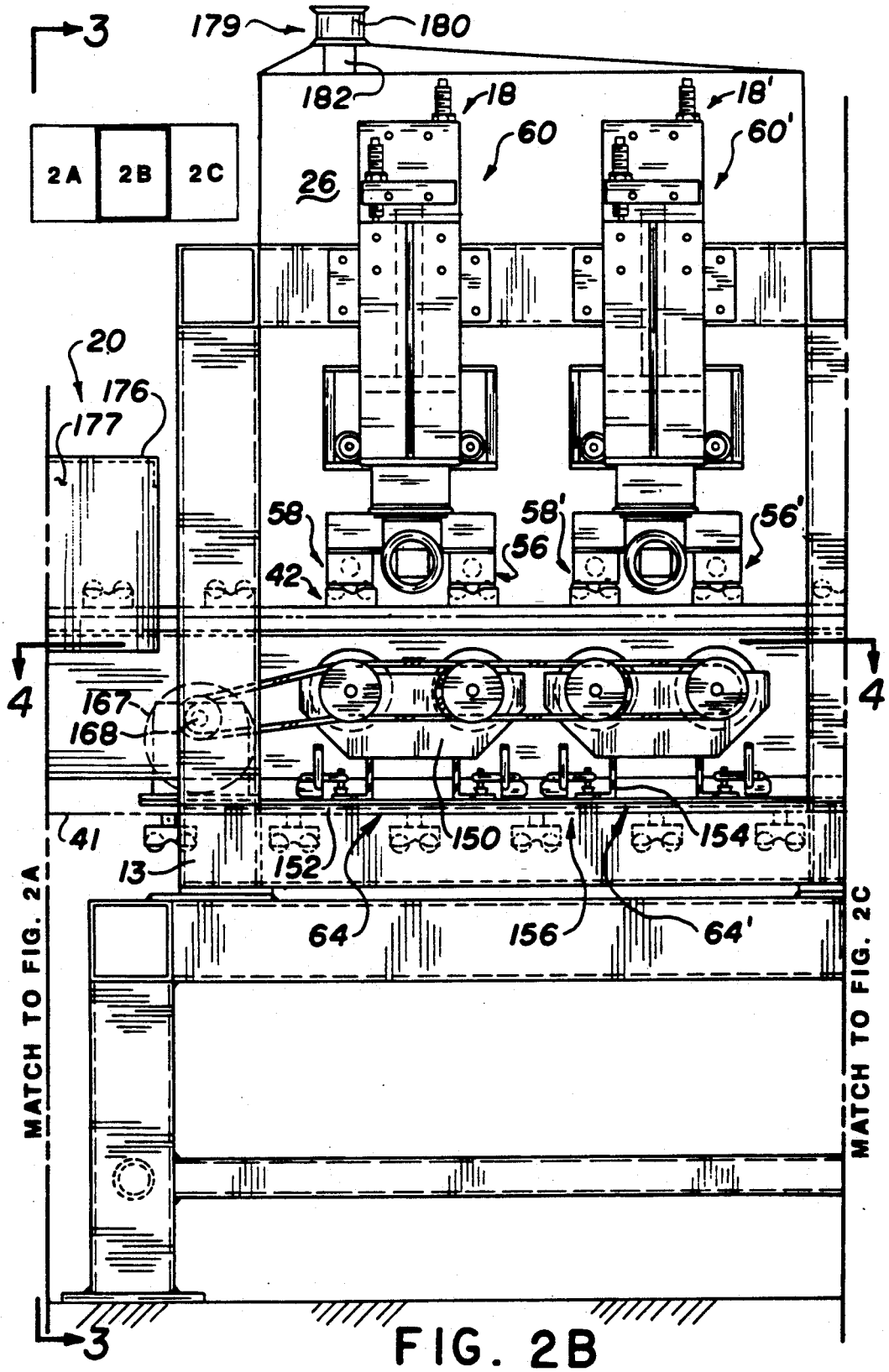

It should be understood that the embodiment of the apparatus 10 illustrated in FIGS. 1A–1C includes a single application system 18 and curing system 20. In the embodiment of apparatus 10 illustrated in FIGS. 2A–2C, two application systems 18 and a single curing system are provided. Additionally, it should be understood that combinations of single or multiple application systems and curing systems may be used to apply numerous primer, secondary or finish materials to the items, as may be desired by one of ordinary skill to complete manufacture of the desired cylindrical items. As the components of the second application system of FIGS. 2A–2C are substantially similarly to the first system, the components of the second system will be referred to with a prime designation, and only the differences between the systems will be discussed in further detail.

The transport, application and curing systems 16, 18, 20 are supported on the frame 12 enclosed within clear walls and hinged covers 26, which are also supported on the support members 13 of the frame 12. The use of clear walls and covers permits the operator to view the apparatus 10 during operation, while preventing exposure to moving parts of the apparatus, or any fumes resulting from application of the material. The walls and covers 26 are manufactured of a clear material, for example Tempered Glass.

Cover or door interlock switches 28 are positioned adjacent each hinged cover 26, and are electrically interconnected to the controller 24. In the event the covers 26 are manually opened during operation of the apparatus 10 the interlock switches 28 operate to cease operation of the apparatus. Such safety interlocks 28 ensure that the operator cannot gain access to the apparatus 10 during operation.

The cylindrical items C to which material M is applied by the apparatus 10 include at least one open end E, and may include an integral flange F on the other end of the cylinder. Cylindrical items are supplied to the transport system 16 at a receiving end 17. The cylindrical items C may be provided manually by an operator, or by use of a conventional rotary or vibratory feed system (not shown).

As schematically illustrated in FIGS. 1A–C and 2A–2C, the transport system 16 for moving the items C through the apparatus 10 is a continuous chain conveyor having multiple assembly work stations 42, as described herein.

The conveyor 30 includes two main support sprockets 32 which are supported on the frame 12 of the apparatus 10. One sprocket is positioned at the receiving end 17 of the transport system, and the second sprocket is positioned at a removing end 21 of the transport system.

In the embodiment illustrated, the conveyor is actuated by a main drive mechanism 34 comprising a conventional gear motor 35 which operates a drive shaft 36 interconnected with a main drive sprocket 38 by a chain drive 39, as shown schematically in FIGS. 1A and 2A.

The main drive sprocket 39 and second support sprocket 32 are rotatably supported on a sprocket drive shaft 40, and are interconnected by a main drive chain 41. Operation of a single drive mechanism 34 enables synchronized movement to be maintained as the cylindrical items C move through the apparatus 10.

As schematically illustrated in FIGS. 1A–2C, the continuous main drive chain 41 of the transport system 16 has multiple assembly work stations 42 supported along its length. The work stations 42 include a bracket 44 interconnected with the drive chain 41, and supporting a base member 46. The base member 46 includes two spaced flanges 47 and has two parallel axles 48 supported between the flanges. Support rolls 50 are rotatably mounted, with one roll on each of the axles 48. As shown in FIG. 3A, the support rolls 50 include a V-shaped portion 51 adjacent one end for engagement with the flange F of a cylindrical item. When a cylindrical item C is engaged with its support rolls, the central axes of both the cylindrical item and each of the support rolls 50 are parallel with respect to one another.

Once the cylindrical items C are engaged in their axially aligned positions on the assembly work stations 42 of the transport system 16 they are moved to the application system 18 for application of the coating material M. An air curtain device 52 is provided in the embodiment of the invention illustrated in FIG. 1B. The air curtain device 52 surrounds an opening 53 in the clear wall 26 enclosing the application system 18. The air curtain device 52 provides a curtain of air across the opening 53 to reduce fume migration from the material M past the walls and covers 26 enclosing the application system 18.

The cylindrical items C are moved through the air curtain device 52 into the application system 18 on the assembly work stations 42 of the transport system 16 as illustrated in FIGS. 2B, 3, 3A and 5. The work stations 42 are positioned along the continuous conveyor 30 with approximately six inches between the center lines dividing the support rolls 50 of each work station 42, as shown in FIG. 2C.

Figure 3:
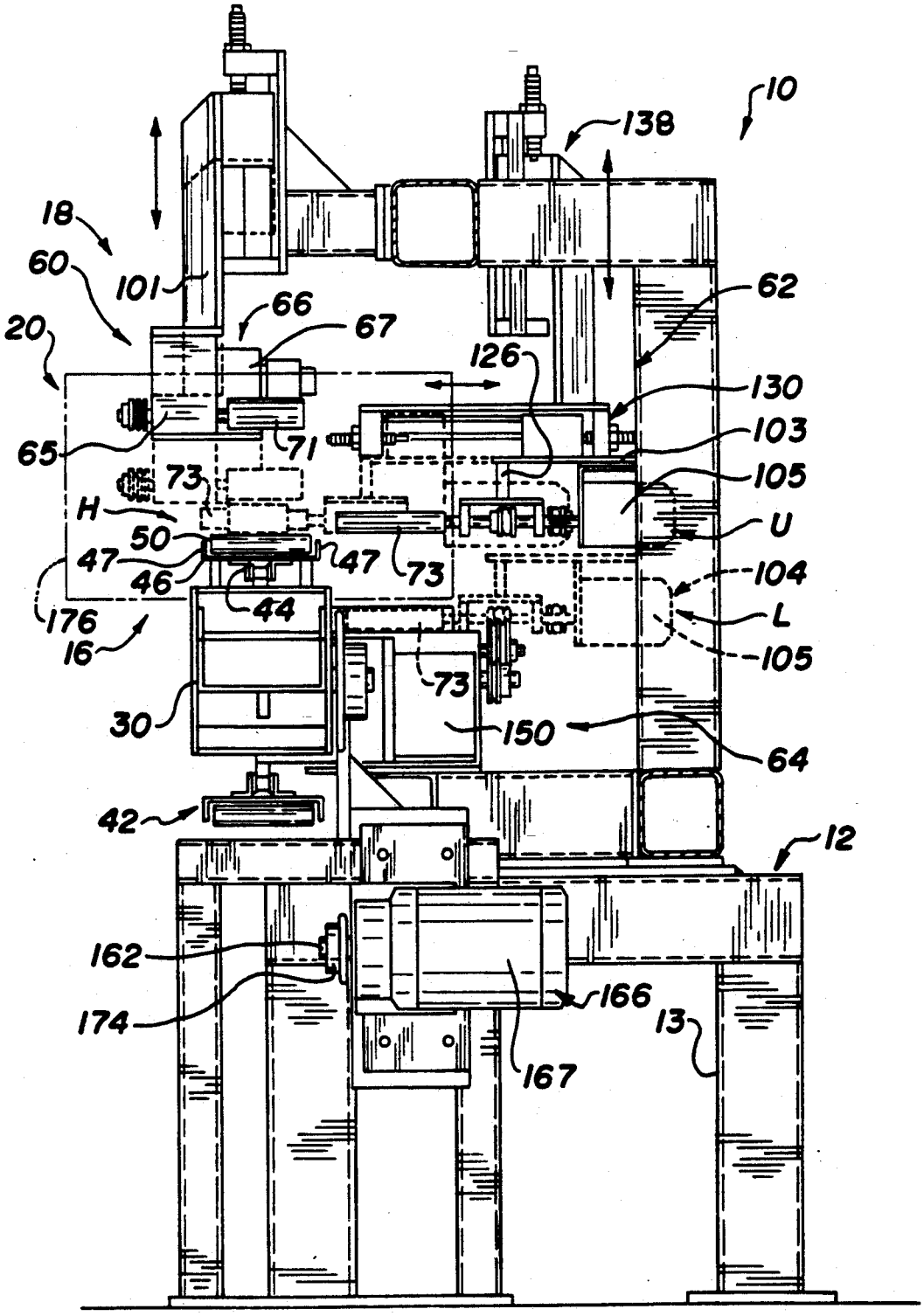
FIG. 3 is a schematic cross-sectional end view of the apparatus taken along the line 3—3 of FIG. 2B.
Figure 3A:
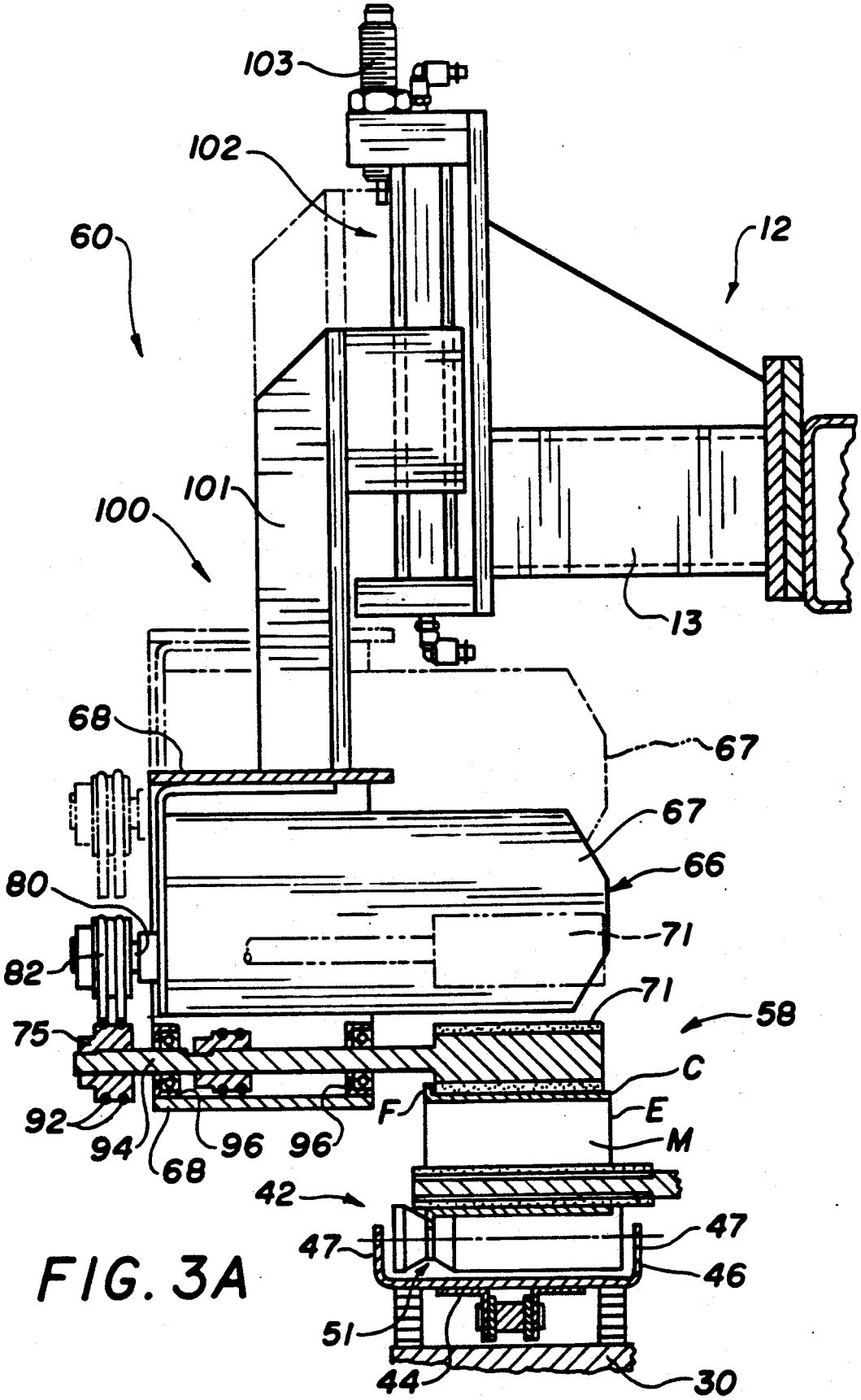
FIG. 3A is a schematic partial cross-sectional end view of the driving system of the apparatus illustrated in FIG. 3.
Figure 3B:
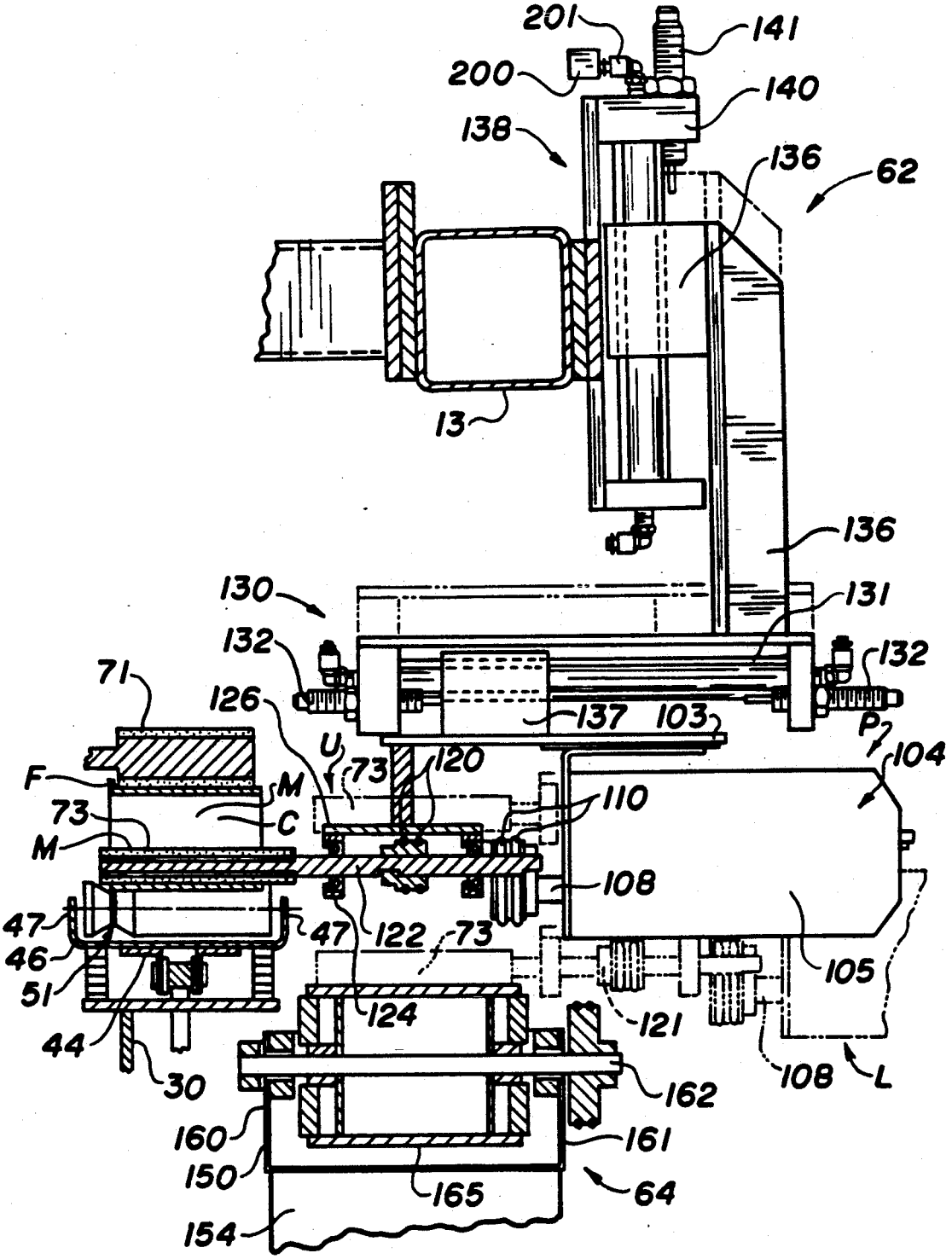
FIG. 3B is a schematic partial cross-sectional end view of the reservoir system of the apparatus illustrated in FIG. 3.
Figure 4:
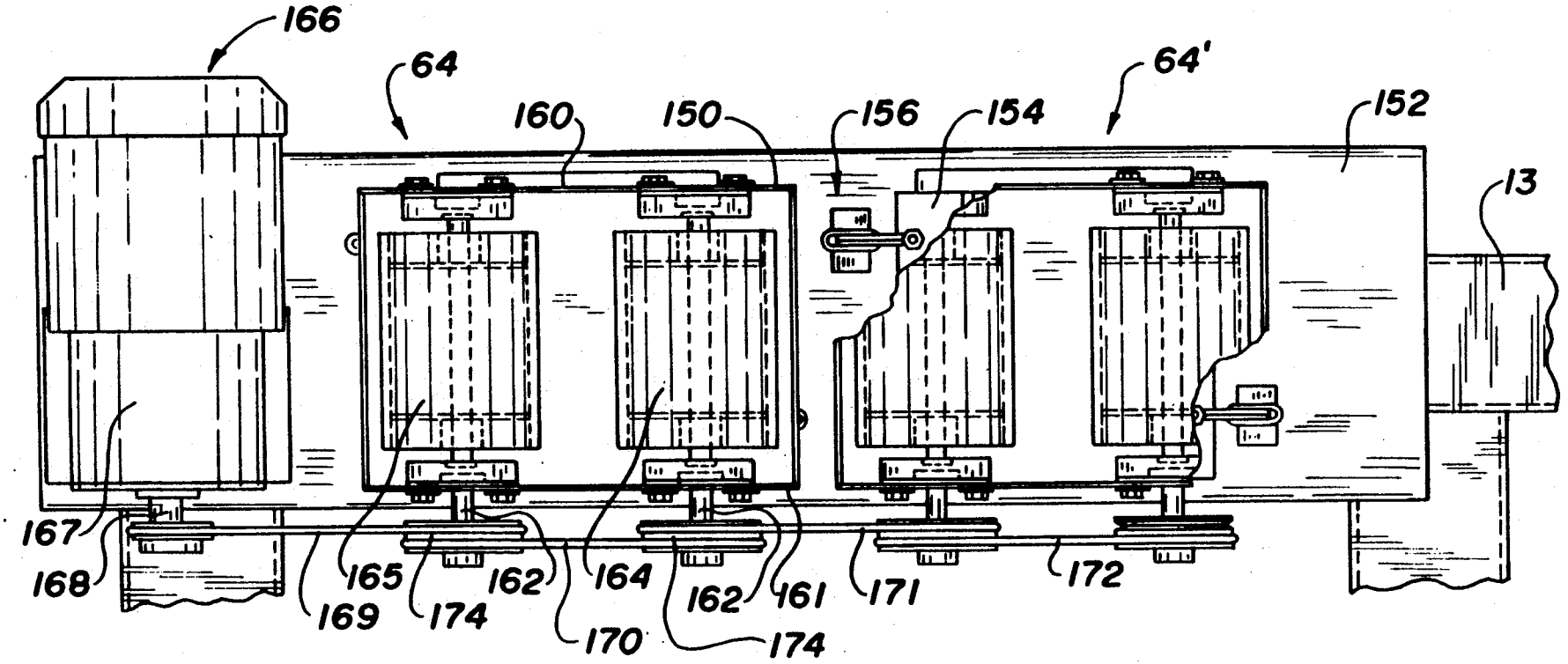
FIG. 4 is a schematic partial top view of the reservoir system of the apparatus taken along the line 4—4 of FIG. 2B.
Figure 5:
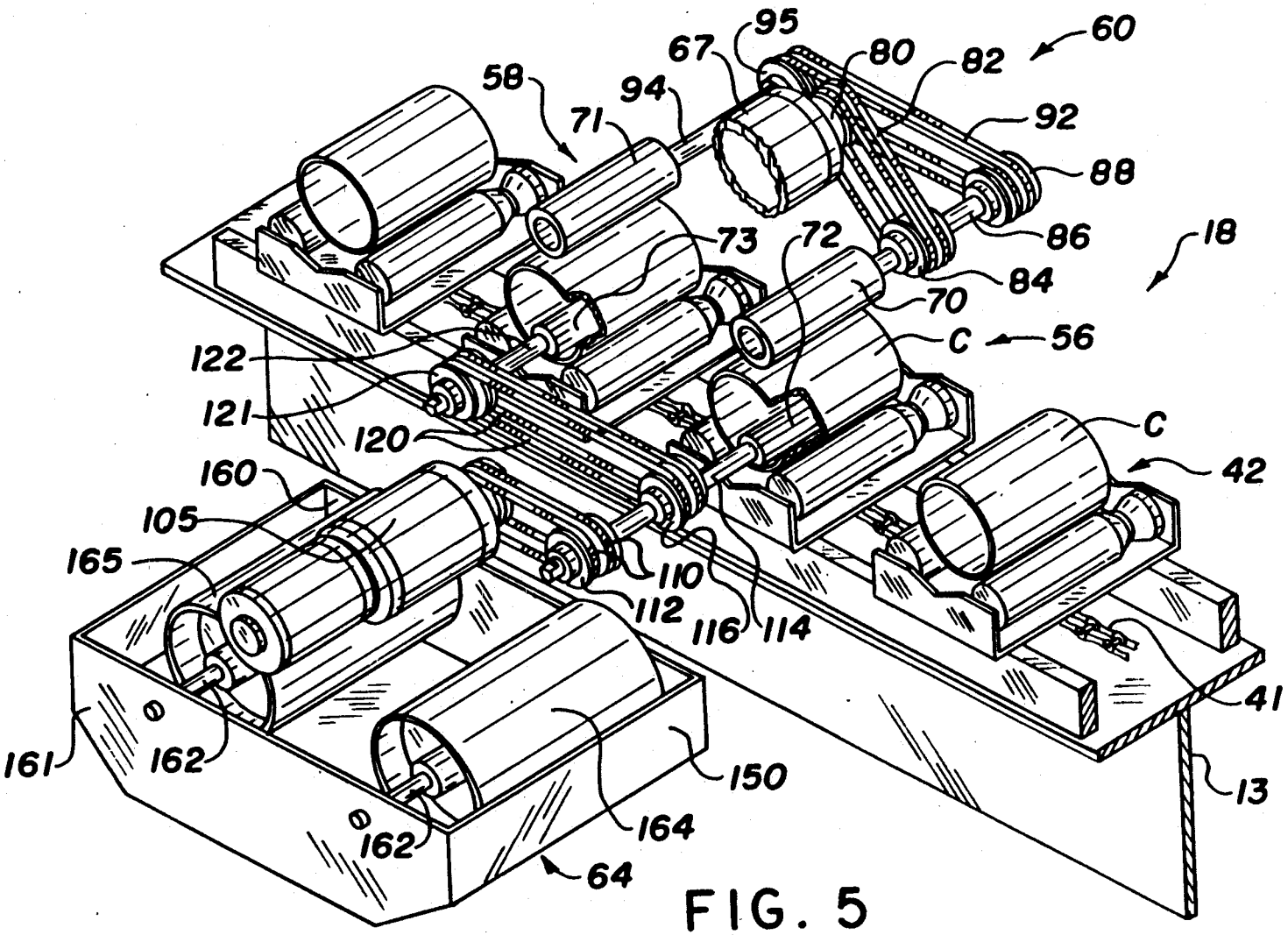
FIG. 5 is a schematic partial perspective view of one embodiment of an application system for coating the internal diameters of cylindrical items in accordance with the present invention.
Figure 6:
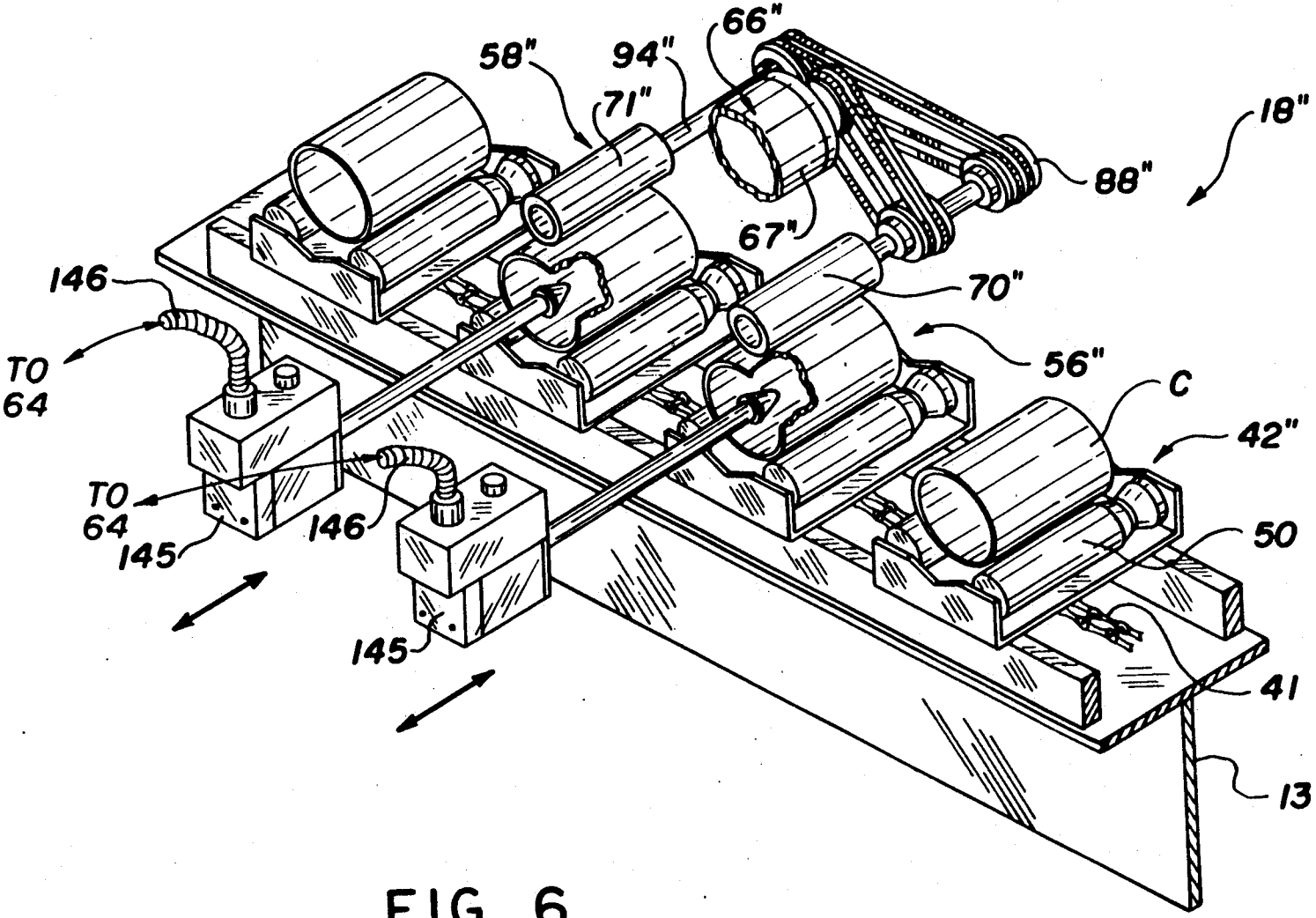
FIG. 6 is a schematic partial perspective view of a second embodiment of an application system for coating the internal diameters of cylindrical items in accordance with the present invention.

The application system 18 of the apparatus of the present invention is illustrated in FIGS. 1B, 2B and 3, and in further detail in FIGS. 3A, 3B and 5. An alternate embodiment of the application system 18'' is illustrated in FIG. 6. It is again noted that a single application system is provided in the embodiment of FIG. 1B, while a pair of application systems 18, 18' are illustrated in the embodiment of FIG. 2B. As the components of the second application system 18' are identical to those in the first application system 18, no further discussion of the second application system is required, and only the differences or additional features provided by the second system will be discussed below.

The application system of the preferred embodiment of FIGS. 3–3B includes first and second coating stations 56, 58, each of which has a driving system 60, a coating roll system 62 and a reservoir system 64. During operation of the application system 18, the driving, coating roll and reservoir systems of each coating station 56, 58, respectively, operate to apply the desired material M to a single item C. Thus, two cylindrical items are coated during each operation of the application system 18. In the event it is necessary, the items may be indexed in pairs through the application system so that each item is coated once, or alternatively, the items may be indexed individually, so that each item is coated twice; once at each coating station 56, 58.

The driving system 60 is illustrated in detail in FIG. 3A. The driving system 60 is operated by a single drive mechanism 66, for both coating stations 56, 58. Each coating station also includes a driving roll 70, 71, each of which is part of the driving system 60 for rotating the cylindrical items during application of a material to their internal diameters. The driving rolls 70, 71 are horizontally and axially spaced from one another, and sequentially engage the external diameter of the cylindrical items C to rotate the items on their support rolls 50 of the assembly work stations 42. The composite material surfaces of the driving rolls 70, 71 engage the external surface of the cylindrical items.

In the embodiment illustrated in FIGS. 3, 3A and 5, the drive mechanism 66 includes a gear motor 67 secured on a mounting plate 68. To rotate the driving rolls 70, 71, the gear motor 67 rotates a drive shaft 80, which is interconnected by belts 82 with a driving roll drive pulley 84 supported on a first driving roll drive shaft 86. The first driving roll drive shaft 86 supports the driving roll 70. An additional drive shaft pulley 88 supported on the first driving roll drive shaft 90 is interconnected by belts 92 to drive a second driving roll drive shaft 94 via a second drive shaft pulley 95. The second driving roll drive shaft 88 supports the driving roll 71. Each of the drive shafts 86, 94 are supported for rotation within ball bearings 96, also secured to the mounting plate 68.

In the illustrated embodiment, the mounting plate 68 also supports one end of a vertical slide mechanism 100, which is secured at another end on the metal support members 13 of the frame 12. The vertical slide mechanism 100 includes a support bracket 101 engaged with a conventional pneumatic linear actuator 102, with a shock absorbing device 103 mounted at the upper end of the actuator. The linear actuator 102 is mounted directly on the metal support member 13, as illustrated in FIG. 3A.

During movement of the assembly work stations 42 to the coating stations 56, 58, aligned under the driving system rolls 70, 71, the slide mechanisms 100 position the driving systems vertically away from the work stations 42 at the location illustrated in phantom in FIG. 3A. Once the cylindrical items C are indexed into alignment under a respective driving roll 70, 71 at coating stations 56, 58, the slide mechanisms 100 vertically lower the driving rolls 70, 71 into engagement with the cylindrical items as shown in solid lines in FIG. 3A. Upon engagement of the driving rolls 70, 71 with the cylindrical items C at each coating station 56, 58, the coating roll system 62 simultaneously engages the internal diameter of the cylindrical item.

In the embodiment of the coating roll system 62 illustrated in FIG. 3B, a single drive mechanism 104 is provided which operates coating rolls 72, 73 at both coating stations 56, 58. The composite material surface of each of the coating rolls 72, 73 engages the internal diameter metal surface of a cylindrical item. The drive mechanism 104 comprises a gear motor 105 in the preferred embodiment, which is secured to a mounting plate 103. The gear motor 105 of the coating roll system 62 rotates the coating rolls 72, 73 at each coating station much as the gear motor 67 of the driving system 66 rotates the driving rolls 70, 71.

The gear motor 105 rotates a drive shaft 108, which is interconnected by belts 110 with a first drive shaft pulley 112 supported on a first coating roll drive shaft 114. A drive shaft pulley 116 on the first coating roll drive shaft 114 is interconnected by belts 120 with a second coating roll drive shaft 122 via a second drive shaft pulley 121. Each of the coating roll drive shafts 114, 122 are rotatably supported within ball bearings 124 secured to a bracket 126 mounted to the mounting plate 103.

Similar to the driving system 60, the mounting plate 103 is engaged with a horizontal sliding mechanism 130. The horizontal sliding mechanism 130 shown in FIG. 3B is a conventional pneumatic linear actuator 131 having shock absorbers 132 engaged at each end of the actuator. The mounting plate 103 is supported on a horizontal slide mount 132 engaged with the linear actuator 131 for vertically moving the coating roll system 62.

The horizontal sliding mechanism 130 is secured to a vertical slide bracket 136 engaged with a vertical slide mount 137 engaged with a vertical slide mechanism 138. The vertical sliding mechanism 138 illustrated is also preferably a conventional pneumatic linear actuator 140 having a shock absorber 141 located at an upper end thereof. A pressure sensor 200 is engaged with a valve 201 in fluid communication with the linear actuator 140, for controlling the pressure with which the coating rolls 72, 73 are engaged with the internal diameters of the cylindrical items. The vertical slide mechanism 138 is supported on the metal support members 13 of the frame 12, which also supports the vertical slide mechanism 100 of the driving system 60.

As shown in the embodiment illustrated in FIG. 3B, the coating roll system 62 is thus moveable between four positions. First, material M is required to be applied to the coating rolls 72, 73. During this operation, the coating roll system is located in the lower most position, generally referenced at reference character L, shown in phantom lines in FIG. 3B. Prior to the application of material to the cylindrical items, the coating roll system is vertically raised to a position generally referred to by reference character U. During application of material M to the internal diameter of the cylindrical items C, the coating roll system 62 is first horizontally moved into the cylindrical item C to a position generally referred to by reference character H in FIG. 3. The coating rolls 72, 73 are then lowered into engagement with the cylindrical items as in position referenced at P illustrated in solid lines in FIG. 3B.

Where the vertical slide mechanism 138 lowers the coating rolls 72, 73 to such a degree that the coating rolls are unable to apply the predetermined amount of material, an increased pressure level is measured by the pressure sensor 200, and the vertical slide me 138 is to raise the coating rolls. Alternatively, where the coating rolls 72, 72 are not lowered sufficiently to engage the internal diameter of the cylindrical items, a decreased pressure level is measured by the pressure sensor 200, and the vertical slide mechanism 138 is actuated to lower the coating rolls for application of the material. Adjustment of the position of the coating rolls is automatic to ensure a constant application of force by the coating rolls and the application of the desired amount of material.

To remove the coating roll from the cylindrical item, the rolls are first vertically raised, and the coating roll system is then returned to the location in the uppermost position U shown in phantom lines. The positions of the coating roll system are also illustrated in phantom and solid lines in FIG. 3.

The alternate embodiment of the application system 18'' is illustrated in FIG. 6. The alternate embodiment enables the application of material to the internal diameter of items where the internal diameter has a complex geometry, which cannot be readily coated by a cylindrical roll. The application system 18'' provides a single spray mechanism 145 for each coating station 56'', 58''. The spray mechanisms 145 are supplied with material M via conduits 146 from a reservoir system (not illustrated). The spray mechanisms are vertically movable into and out of engagement with the cylindrical items in the direction of the arrows shown in FIG. 6.

Returning now to the application system embodiment of FIG. 5, the coating rolls 72, 73 are supplied with material M by engagement with the reservoir system 64, which is shown in further detail in FIG. 6. The reservoir system 64 includes a tank 150 supported on a mounting plate 152 engaged with the metal support members 13 of the frame 12. Tank support members 154 are positioned intermediate the tank 150 and mounting plate 152, and are secured to the mounting plate by toggle clamps 156.

The tank 150 includes two spaced walls 160, 161, and has two parallel axles 162 supported for rotation within bearings 163 positioned between the walls. Supply rolls 164, 165 are mounted on the axles 162, one on each of the axles. The metal surfaces of the supply rolls 164, 165 engage the surfaces of the coating rolls 72, 73 to transfer material M from the supply rolls to the coating rolls.

The reservoir system 64 includes a single drive mechanism 166 for rotating the supply rolls 164, 165. The drive mechanism, which comprises a gear motor 167, is secured to the mounting plate 152. To rotate the supply rolls 164, 165, the gear motor 167 rotates a drive shaft 168, which is interconnected by a series of belts 169, 170, 171, 172 with axle pulleys 174 on each of the axles 162. Like the rolls of the driving and coating roll systems 60, 62, the supply rolls 164, 165 of the reservoir system 64 are also variable between 9 and 45 rpm. Such variable speed capability enables material to be applied to the coating rolls by the supply rolls as may be necessary to change the material thickness applied to the cylindrical items.

During operation of the application system 18, the tank 150 contains the desired material M. Additionally, where two application systems 18, 18' are used, as illustrated in FIG. 2B, the tanks may contain the same or different material M, as may be desired. Since the amount of material to be applied to the cylindrical items C is primarily determined by the length of engagement between the cylindrical items C and the coating rolls 104, 105, the speed of the transport system 16 and the driving rolls 102, 103 of the driving system, may be varied as is necessary. The speed of the main drive mechanism 34 of the transport system 16 may be varied between 10 feet per minute and 40 feet per minute. By varying the speed of the transport system, the processing speed of items moving into and out of the application system in the assembly work stations 42 may be increased or decreased as necessary. Additionally, the speed may be increased manually, using a key pad control 25 or, once experimentally established, may be automatically controlled by the controller 24 based on the diameter of the cylindrical item C.

The speed of both the driving system 60 and coating roll system 62 of the application system 18 may also be varied between 9 rpm and 45 rpm. By varying the speed of the rolls of the application system 18, the speed at which material is applied to the items C may be increased or decreased as necessary to change the material thickness. The application system 18 speed may be increased manually using the key pad controls 25, or, once experimentally established, may be automatically controlled by the controller 24. The direction of operation of the rolls of the driving, coating roll and reservoir systems 60, 62, 64 may also be varied to obtain the desired engagement time between the various rolls and the cylindrical items.

Upon exiting the application system 18 on the assembly work stations 42, the cylindrical items C having material M applied to the internal surface, are moved into the curing system 20. In the illustrated embodiment of FIGS. 1A and 2A, the cylindrical items are moved via the transport system 16 through a heating and drying chamber 176. Alternatively, an individual heating chamber or drying chamber, which provides ambient air, may be used as the curing system 20. The heating and drying chamber 176 includes a temperature system 178 for increasing the temperature of the air within the chamber. As shown in FIGS. 1A and 2A, the heating and drying chamber is enclosed by walls 177 of Tempered Glass which are supported on the metal support members 13 of the frame 12.

The heating and drying chamber 176 includes a ventilation system 202 which provides ambient air within the chamber 176. The ventilation system 202 introduces ambient air into the heating and drying chamber 176 via a fan assembly 203 located behind the chamber. The fan assembly 203 provides air to the heating and drying chamber 176 for directing drying air across the coated surfaces of the cylindrical items.

The transport system 16 moves the assembly work stations 62 through the heating and drying chamber 176 via the conveyor 30. An exhaust system 179 is also provided which removes air and fumes from the application system 18 via a fan assembly 180. The fan assembly 180 of the exhaust system 179 is located on the top of the walls 26 enclosing the application system 18, and pulls air in an upward direction through the chamber. During operation of the exhaust fan assembly, a negative pressure may be created within the application system 18 which removes interfering fumes from the system via the fan assembly 180. By maintaining and controlling operation of the exhaust system fan assembly, the air flow through the application system and surrounding the cylindrical items may be controlled at the desired rate.

Control of the exhaust system 179 additionally enables control of any environmental exhaust requirements by establishing the rate of exhaust exiting the application system using the fan assembly 180. To ensure that the proper exhaust requirements are maintained, an air flow safety sensor 182 is provided in connection with the fan assembly 180. The air flow sensor 182 is electrically interconnected between the fan assemblies 180, 203 and the controller 24. In the event the operation of the fan assembly is less than that necessary to maintain environmental exhaust requirements, operation of the apparatus 10 shuts off. By interlocking or interconnecting the ventilation system 202 and the exhaust system 179 with operation of the apparatus 10, the accumulation of fumes within the application system 18 is prevented. Manual operation of the fan assemblies 203, 180 may be provided via the key pad controls 25, or automatically, using the controller 24.

Once the cylindrical items are cured within the heating chamber 176 they are removed from their assembly work stations on the transport system conveyor 30 via an exit ramp 188 or take-away device as shown in FIGS. 1A, 2A. Upon exiting the ramp 188 under gravity, the cylindrical items may be provided to a take-away container (not illustrated), or a take-away system (not illustrated) which may be used to transfer the items to a still further and any final processing station.

Accordingly, an apparatus 10 for applying material to cylindrical items C has been described above which may be manually or automatically controlled. In the illustrated embodiment, the operating parameters, such as speeds of the transport system 16, application systems 18, 18' and curing system 20 are programmed into the controller 24. The desired operating parameters for the systems are determined experimentally depending on the diameter of the cylindrical item C and the material M to be applied. Once the desired parameters are established, they are programmed into the controller 24 for the various items and materials. Once the controller 24 is programmed, the systems of the apparatus 10 may be readily and automatically changed to apply the desired material to the desired items by entering the name of the desired item and materials to be manufactured using the key pad controls 25.

Upon receiving instructions concerning the items and materials to be manufactured, the controller 24 then adjusts the necessary operating parameters and settings of the various systems to produce the desired result. The controller 24 of the preferred embodiment is a conventional digital computer electrically interconnected with the power supplies and controls of the systems of the apparatus 10. As shown in FIGS. 1C and 2C, the controller interface includes the key pad control 25 for use by the operator of the apparatus 10.

The preferred form of the apparatus of the present invention has been described above. However, with the present disclosure in mind it is believed that obvious alterations to the preferred embodiments, to achieve comparable features and advantages in other application devices, will become apparent to those of ordinary skill in the art.

We claim:

1. An apparatus for application of a material to the internal surface of cylindrical items of manufacture, said apparatus comprising a frame, a transport system, an application system, and a curing system for curing material applied to said cylindrical items of manufacture, said frame supports said transport system said transport system comprises a continuous conveyor system with a plurality of work stations movably supporting said cylindrical items and transporting said items supported within said work stations to said application system and said curing system, each of said work stations including first and second horizontally, axially spaced support rolls secured to said conveyor system, said application system comprising a drive roll vertically movable into driving engagement with said cylindrical item supported within said work station, a vertically and horizontally movable coating roll engagable with said internal surface of said cylindrical item to apply the desired material and with a reservoir system having a rotatable supply roll supplying said coating roll with material, said coating roll of said application system being movable between a first position engaged with said cylindrical item for applying material to said internal surface thereof during movement of said drive roll, and a second position engaged with said supply roll of said reservoir system.

2. The apparatus of claim 1 wherein said apparatus includes a preprogrammed computer for automatically controlling the application of material to said items and movement of said items through said transport, application and curing systems depending on the material being applied.

3. The apparatus of claim 2 wherein said application system is enclosed to prevent migration of material fumes from the apparatus.

4. The apparatus of claim 3 wherein said curing system comprises a heating chamber wherein said cylindrical items are moved through said heating chamber, supported in said transport system work stations, and subjected to increased temperatures.

5. The apparatus of claim 4 further comprising a ventilation system for removing air and material fumes from the application system during operation.

6. An apparatus for application of a material to the internal surface of cylindrical items of manufacture, said apparatus comprising a frame, a transport system, an application system, a curing system for curing the material applied to said cylindrical items of manufacture and a programmable computer for automatically controlling the application of material to said items and movement of said items through said transport, application and curing systems depending on the material being applied, said frame for supporting said transport system, said transport system comprising a continuous conveyor system having a plurality of work stations movably supporting said cylindrical items and transporting said items supported within said work stations to said application system and said curing system, said application system comprising first and second horizontally, axially spaced coating rolls engagable with said internal surface of said cylindrical item supported within said work station to apply the desired material, and a reservoir system for supplying said coating rolls with material, said application system including an adjustment mechanism for controlling the application pressure applied by said coating rolls to said internal surface of said cylindrical item.

* * * * *